United States Patent [19]

Snelling et al.

[11] 4,373,799

45] Feb. 15, 1983

[54] MULTI-MODE ELECTROSTATOGRAPHIC PRINTING MACHINE

[75] Inventors: Christopher Snelling; Myron J. Lenhard, both of Penfield, N.Y.

[73] Assignee: Xerox Corporation, Stamford, Conn.

[21] Appl. No.: 339,539

[22] Filed: Jan. 15, 1982

Related U.S. Application Data

[63] Continuation of Ser. No. 28,616, Apr. 9, 1979, abandoned.

[51] Int. Cl.[3] ..... G03G 15/14; G03G 15/18

[52] U.S. Cl. ..... 355/3 R; 346/153.1; 355/3 TE; 355/3 TR

[58] Field of Search ..... 355/3 R, 3 TE, 3 TR, 355/6, 7, 14 R, 77; 354/3, 5; 346/153.1, 160; 430/48

[56] References Cited

U.S. PATENT DOCUMENTS

| | | | |
|---|---|---|---|
| 3,045,587 | 7/1962 | Schwertz | 355/3 R X |
| 3,147,679 | 9/1964 | Schaffert | 355/3 TE |
| 3,666,458 | 5/1972 | Arneth et al. | 355/3 TE X |
| 3,738,855 | 6/1973 | Gundlach | 430/48 X |
| 4,026,642 | 5/1977 | Tanaka et al. | 355/3 R X |
| 4,042,962 | 8/1977 | Yamaji et al. | 355/11 X |
| 4,124,286 | 11/1978 | Barasch | 355/3 R |
| 4,128,328 | 12/1978 | Matsui | 355/3 DD |
| 4,166,691 | 9/1979 | Ebi et al. | 355/3 TR X |
| 4,167,324 | 9/1979 | Wu | 355/3 R |
| 4,200,389 | 4/1980 | Matsui et al. | 355/3 FU |

*Primary Examiner*—Fred L. Braun

*Attorney, Agent, or Firm*—H. Fleischer; J. E. Beck; R. Zibelli

[57] ABSTRACT

A multi-mode electrostatographic printing machine. A first latent image is recorded on a photoconductive member. The first latent image is transferred to a dielectric sheet. Subsequent to this transfer, the sheet is moved to a position where a second image is formed on the dielectric sheet by a stylus array having a plurality of individually actuatable stylii. Operator controls allow either of or both the latent images to be formed on the dielectric sheet. The multi-mode of operation can be extended to include a third image forming device for causing a third latent image to be recorded on the photoconductive member and subsequently transferred to the dielectric sheet. The operator controls are similarly extended to allow any combination of the three images to be formed on the dielectric sheet.

5 Claims, 1 Drawing Figure

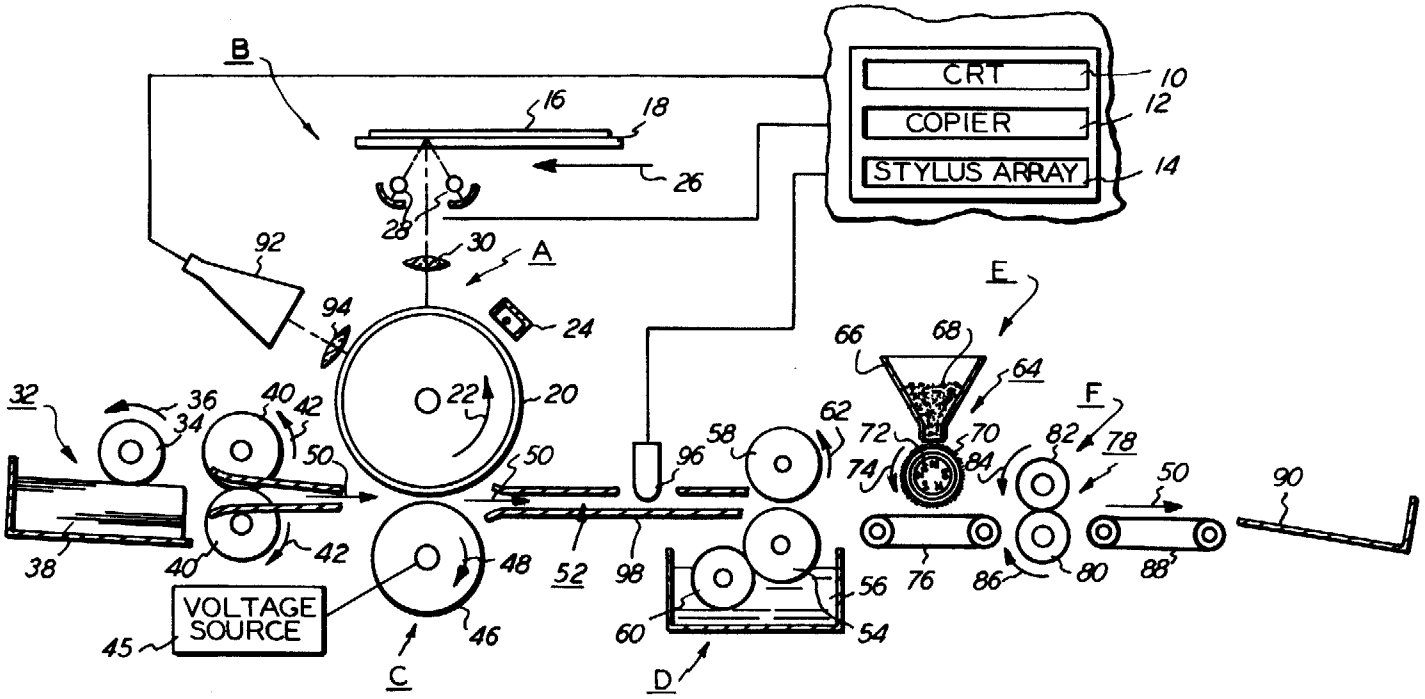
CRT
COPIER
STYLUS ARRAY
VOLTAGE SOURCE
A
B
C
D
E
F

MULTI-MODE ELECTROSTATOGRAPHIC PRINTING MACHINE

This is a continuation of application Ser. No. 028,616, filed Apr. 9, 1979, now abandoned.

This invention relates generally to a multi-mode electrostatographic printing machine. More particularly, this invention concerns an electrostatographic printing machine arranged to operate in electrographic and electrophotographic modes.

The process of electrostatographic printing requires the formation and utilization of a electrostatic latent image for the purpose of recording and reproducing patterns in viewable form. Electrostatographic printing may include electrophotographic printing and electrographic printing. In electrophotographic printing, electromagnetic radiation is used to form an electrostatic latent image on a photoconductive member. An electrographic printing machine employs an insulating medium to form, without the aid of an electromagnetic radiation, an electrostatic latent image. Generally, the process of electrophotgraphic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained within the original document being reproduced. After the electrostatic latent image is recorded on the photoconductive member, the latent image is developed by bringing particles of a developer mix into contact therewith. The developer mix particles are attracted to the latent image forming a particle image on the photoconductive member. The particle image is then transferred from the photoconductive member to a copy sheet. Finally, the copy sheet is heated to permanently affix the particles thereto in an image configuration. This general approach was disclosed by Carlson in U.S. Pat. No. 2,297,691 and has been further amplified and described by many related patents in the art.

In electrophotographic printing, the electrostatic latent image comprises electrostatic surface charges. These surface charges may be transferred to, or reproduced upon, other dielectric surfaces. The technique for accomplishing charge transfer is referred as a TESI process, from transfer of electrostatic images. Hence, electrostatic latent image may be transferred to another surface prior to development. The material to which the electrostatic latent image is transferred must, of course, be capable of retaining the image, i.e. it must be a good insulator. Electrostatic latent images may be transferred to dielectric coated papers. The transferred images can be developed by the same methods hereinbefore described for developing the electrostatic latent image recorded on the photoconductive member. However, since the charge on the dielectric surface is not dissipated by exposure to light, it is not necessary to shield the image from light during development. When the electrostatic latent image has been transferred to a dielectric sheet, the powder image developed thereon may be subsequently fused thereto forming a finished copy sheet.

In electrographic printing, an electrostatic latent image is produced on a dielectric surface by the use of electrodes. Electrostatic latent images produced in this manner can be made visible by bringing developer mix particles into contact therewith. The resultant particle image may then be permenantly affixed to the dielectric sheet or transferred therefrom to a copy sheet.

Various types of electrostatographic printing machines have hereinbefore been employed to utilize the foregoing processes. The following disclosures appear to be relevant:

U.S. Pat. No. 2,825,814
Patentee: Walkup
Issued: Mar. 4, 1958

U.S. Pat. No. 3,686,676
Patentee: Howell et al.
Issued: Aug. 22, 1972

U.S. Pat. No. 4,042,962
Patentee: Yamaji et al.
Issued: Aug. 16, 1977

The relevant portions of these disclosures may be briefly summarized as follows:

Walkup describes an electrophotographic printing process in which an electrostatic latent image recorded on a photoconductive member is transferred to a dielectric member by applying a D.C. potential therebetween.

Howell et al. discloses an electrographic recording apparatus wherein electrostatic charges are placed on a recording medium by means of electrically pulsed electrodes or styli.

Yamaji et al. discloses an electrophotographic printing machine in which an electrostatic latent image is recorded on a photoconductive member by charging and then exposing the charged portion of the photoconductive member. Exposure is accomplished by illuminating an original document and then transmitting the light rays reflected therefrom through a lens which focuses the light image onto the charged portion of the photoconductive member recording the electrostatic latent image thereon. Alternatively, a cathode ray tube may be utilized to expose the charged portion of the photoconductive member. In another mode of operation, a transmission head records a telegraphic image directly on the photoconductive member.

In accordance with the features of the present invention, there is provided a multi-mode electrostatographic printing machine. The printing machine includes a dielectric member arranged to be positioned closely adjacent to a photoconductive member. Means are provided for recording a first electrostatic latent image on the photoconductive member and transferring the first electrostatic latent image to the dielectric member. Means form a second electrostatic latent image on the dielectric member. Operator selectable means energize the recording means and the forming means simultaneously or individually.

Other features of the present invention will become apparent as the following description proceeds and upon reference to the FIGURE, in which is shown a schematic elevational view illustrating a multi-mode electrostatographic printing machine incorporating the features of the present invention therein.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

For a general understanding of a multi-mode electrostatographic printing machine, reference is had to the drawing. In the drawing, like reference numerals have been used throughout to designate identical elements. The drawing schematically depicts the various components of the multi-mode electrostatographic printing machine having the various features of the present invention therein. Inasmuch as the art of electrostatographic printing is well known, the various processing stations employed in the printing machine will be shown hereinafter schematically and their operation described with reference thereto.

As shown in the drawing, the machine operator may select any or all of three modes of operation. If the machine operator depresses button 10 marked "CRT", a cathode ray tube will be energized to illuminate the charged portion of a photoconductive drum. This records a latent image corresponding to the informational areas contained within the cathode ray tube on the photoconductive drum. Alternatively, if the machine operator depresses button 12, marked "COPIER", an original document disposed upon a platen of the electrostatographic printing machine will be reproduced. Finally, if the machine operator depresses button 14, marked "STYLUS ARRAY", information transmitted to a stylus array or electrodes will be recorded on the copy sheet and reproduced. The machine operator has the option of selecting any of the foregoing modes of operation or all of them simultaneously. The multimode electrostatographic printing machine hereinafter described prints electrophotographically and electrographically. In order to reproduce the information contained on the cathode ray tube or on the opaque original document, the printing machine operates in the electrophotographic printing mode. However, when the information is being transmitted to the stylus array, the printing machine operates in electrographic mode. These modes of operation may be combined to produce a composite single copy containing information from the opaque original document, the cathode ray tube, and the stylus array. Thus, the printing machine may operate in any or all of the foregoing modes.

Initially, drum 20 moves a portion of the photoconductive surface through charging station A. At charging station A, a corona generating device, indicated generally by the reference numeral 24, charges the photoconductive surface of drum 20 to a relatively high, substantially uniform potential.

Thereafter, the charged portion of the photoconductive surface of drum 20 is advanced through exposure station B. At exposure station B, original document 16 is positioned face-down upon transparent platen 18. Transparent platen 18 moves in the direction of arrow 26. The exposure system, includes stationary lamps 28 which illuminate the original document disposed on the moving platen. As the platen moves, incremental width light images are formed which are projected through lens 30. Lens 30 focuses these light images onto the photoconductive surface of drum 20. The angular velocity of drum 20 is synchronized to that of the linear velocity of platen 18. In this manner, the charged photoconductive surface of drum 20 is discharged selectively by the light image of the original document. This records an electrostatic latent image on the photoconductive surface of drum 20 which corresponds to the informational areas contained within original document 16.

Next, drum 20 advances the electrostatic latent image recorded on the photoconductive surface to transfer station C. At transfer station C, the electrostatic latent image recorded on the photoconductive surface of drum 20 is transferred to a dielectric sheet. The dielectric sheet is advanced to transfer station C in synchronism with the advancement of the electrostatic latent image thereto. A sheet feeding apparatus, indicated generally by the reference numeral 32, advances the dielectric sheet to transfer station C. Preferably, sheet feeding apparatus 32 includes a feed roll 34 rotating in the direction of arrow 36. Feed roll 34 contacts the uppermost sheet of a stack of dielectric sheets 38. Each dielectric sheet may be of any composition suitable for electrographic recording. Mylar a registered trademark, polystyrene and polyethylene are examples of coatings which may be formed on plain paper to produce a dielectric sheet capable of retaining an electrostatic latent image thereon. As feed roll 34 rotates in the direction of arrow 36, the uppermost dielectric sheet is advanced from stack 38 to registration rollers 40. Registration rollers 40 rotate in the direction of arrows 42 to align and forward the advancing dielectric sheet into chute 44. Chute 44 directs the advancing dielectric sheet into contact with the photoconductive surface of drum 20 in a timed sequence so that the electrostatic latent image recorded thereon is positioned opposed therefrom at transfer station C.

At transfer station C, the electrostatic latent image is transferred from drum 20 to the dielectric sheet. Inasmuch as the charge on the dielectric sheet is not dissipated by exposure to light, it is not necessary to shield the image from light during the subsequent processing steps. The dielectric sheet contacts a electrode 46. Electrode 46 is preferably an elongated roller rotating in the direction of arrow 48 so as to continue to advance the dielectric sheet in the direction of arrows 50. Roller 46 rotates in synchronism with drum 20. Voltage source 45 is connected between roller 46 and the conductive backing, i.e. aluminum of drum 20. Voltage source 45 applies an electrical field between the conductive backing of drum 20 and roller 46. The dielectric sheet is in contact with roller 46. The electrical field applied by voltage source 45 is of a suitable magnitude and polarity to transfer the electrostatic latent image from the photoconductive surface of drum 20 to the dielectric sheet. Preferably, voltage source 45 produces a potential difference between the conductive backing of drum 20 and conductive roller 46 of about 1,000 volts. The dielectric sheet is spaced from the photoconductive surface of drum 10. Preferably, the spacing between the dielectric sheet and the photoconductive surface of drum 20 is in the order of several microns. Roller 46 is made preferably from a suitable material such as aluminum or copper. Various techniques have hereinbefore been described teaching the process of transferring an electrostatic latent image from a photoconductive surface to a dielectric sheet. Typical techniques are described in U.S. Pat. No. 2,833,648 issued to Walkup in 1958, U.S. Pat. No. 2,937,943 issued to Walkup in 1960, U.S. Pat. No. 2,975,052 issued to Fotland et al. in 1961, U.S. Pat. No. 2,982,647 issued to Carlson in 1961, and U.S. Pat. No. 3,055,006 issued to Dreyfoos et al. in 1962. The relevant portions of the foregoing patents are hereby incorporated into the present application.

After the electrostatic latent image is transferred to the dielectric sheet, a plurality of rollers (not shown) advance the dielectric sheet along chute 52 to moistening station D. At moistening station D rollers 54 and 56, immersed in liquid 58, coat the backside of the dielectric sheet with a liquid 56 so as to improve the conductivity thereof. Preferably, liquid 56 is water which may have salt added thereto to improve the characteristics thereof. Roller 58 presses the dielectric sheet into contact with roller 54 so as to meter a precise quantity of liquid onto the backside of the dielectric sheet. Roller 60 controls the amount of liquid absorbed by roller 54 for application to the backside of the dielectric sheet. Preferably, rollers 54 and 60 may be foam or a suitable brush-like material. Roller 58 rotates in the direction of arrow 62 so as to continue to advance the dielectric sheet in the direction of arrow 50. After the dielectric sheet has been moistened, it advances to development station E.

At development station E, a magnetic brush development system, indicated generally by the reference numeral 64, advances magnetic particles into contact with the electrostatic latent image formed on the dielectric sheet. Magnetic brush system 64 includes a hopper 66 for holding a supply of magnetic particles 68 therein. The magnetic particles 68 are metered from hopper 66 onto tubular member 70. Preferably, tubular member 70 is made from a non-magnetic material such as aluminum. An elongated magnetic member 72 is disposed interiorly of tubular member 70. In this manner, a magnetic field is created which attracts magnetic particles 68 to tubular member 70. Tubular member 70 rotates in the direction of arrow 72 so as to advance the magnetic particles 68 into contact with the electrostatic latent image formed on the dielectric sheet. Conveyor 76 advances the dielectric sheet through development station C. Preferably, conveyor 76 includes a plurality of conductive fins for supporting the sheet thereon. These conductive fins provide an electrode arrangement which the moistened dielectric sheet rides on during development to assure contact in a regular pattern. A voltage source (not shown) applies an electrical potential of suitable magnitude and polarity between conveyor 76 and tubular member 70 to insure development of the electrostatic latent image formed on the dielectric sheet. U.S. Pat. No. 3,714,665 issued to Mutschler et al. in 1973 describes a suitable structure for moistening a sheet prior to the process of development. The relevant portions of this patent are hereby incorporated into the present application.

After the electrostatic latent image formed on the dielectric sheet has been developed with magnetic particles, the dielectric sheet is advanced to fusing station F. Fusing station F, indicated generally by the reference numeral 78, includes a back-up roller 80 and a heated fuser roller 82. The dielectric sheet with the powder image thereon passes between back-up roller 80 and fuser roller 82. Fuser roller 82 rotates in the direction of arrow 84 and back-up roller 80 rotates in the direction of arrow 86. In this manner, both of the foregoing rolls continue to advance the dielectric sheet in the direction of arrow 50. The powder image contacts fuser roller 82 and the heat and pressure applied thereto permanently affixes it to the dielectric sheet. While a heated pressure roller system has been heretofore described, one skilled in the art will appreciate that if suitable magnetic particles are employed, a cold roll pressure system may be employed in lieu thereof. Thus, rollers 80 and 82 would both be cold rather than having roller 82 heated.

After fusing, conveyor 88 advances the finished copy sheet, in the direction of arrow 50, to catch tray 90. When the sheet is in catch tray 90, it may be subsequently removed therefrom by the machine operator.

The process heretofore described is only one mode of operation for the electrostatographic printing machine, i.e. wherein an opaque original document is disposed on the transparent platen. In this mode of operation, the machine operator has depressed button 12 marked "COPIER". Alternatively, the electrostatographic printing machine may operate in any of the other modes of operation. For example, if an opaque original document is not positioned on the transparent platen, but information is received on the cathode ray tube, the machine operator would depress the button 10 marked "CRT". In this mode of operation, the photoconductive surface of drum 20 is charged to a substantially uniform level as heretofore described at charging station A by corona generating device 24. After a portion of the photoconductive surface has been charged, it moves to exposure station B. At exposure station B, cathode ray tube 92 projects a light image of an original document through lens 94. Lens 94 focuses the light image received from cathode ray 92 onto the charged portion of photoconductive surface of drum 20. The light image selectively discharges the charge thereon forming an electrostatic latent image on the photoconductive surface of drum 20. Thereinafter, the electrostatic latent image recorded on the photoconductive surface of drum 10 proceeds through the same processing stations as the electrostatic latent image recorded on photoconductive surface 12 by the utilization of an opaque original document disposed on a transparent platen, i.e. the process heretofore described.

Sheet feeding apparatus 32 advances the dielectric sheet to transfer station C in synchronism with the electrostatic latent image recorded on the photoconductive surface of drum 20. At transfer station C, voltage source 45 produces an electrical field between roller 46 and the conductive backing of drum 20 so as to transfer the electrostatic latent image on the photoconductive surface of drum 20 to the dielectric sheet. The rollers in chute 52 continue to advance the dielectric sheet in the direction of arrow 50 to moistening station D.

At moistening station D, roller 54 applies a liquid coating, preferably water, to the backside of the dielectric sheet improving the conductivity thereof. The dielectric sheet is then advanced to development station E where tubular member 70 advances magnetic particles into contact with the electrostatic latent image thereon. The magnetic particles are attracted to the electrostatic latent image forming a powder image.

Next, the dielectric sheet is advanced through fusing station F. At fusing station F, fusing apparatus 72 permanently affixes the powder image to the dielectric sheet. Conveyor 88 then advances the sheet to catch tray 90. It is thus apparent that the second mode of operation i.e. wherein cathode ray tube 92 is energized, is substantially the same as the mode utilizing an opaque original document. The distinction resides in the manner in which exposure station B operates. It should be noted that if desired, both the cathode ray tube and the copying mode of operation may be operated simultaneously. For example, a opaque original document may be reproduced and the cathode ray tube may form a screen pattern in superimposed registration thereon.

Alternatively, the opaque original document may be a standard form with the cathode ray tube providing specific information therefor. Thus, the electrostatic latent image recorded on the photoconductive surface of drum 20 may be a composite latent image containing information from the cathode ray tube and the opaque original document. It is thus evident that the electrostatographic printing machine may operate in either the copying mode wherein only an original document is reproduced, or in the CRT mode wherein information from a cathode ray tube is reproduced. Not only may the electrostatographic printing machine operate in either of those modes but it may also operate in both of those modes simultaneously to record information on a common electrostatic latent image from both of the foregoing information sources.

Considering now the third mode of operation, where only "STYLUS ARRAY" button 14 is actuated. In this mode of operation, the dielectric sheet is advanced by sheet feeding apparatus 32 through chute 44 and between roller 46 and drum 20 to chute 52. The surface of chute 52 is a segmented conductive backing electrode for supporting the backside of the dielectric sheet. A stylus array 96 is positioned closely adjacent to the surface of the segmented backing electrode 98 as it moves thereacross. Stylus array 96 is a sheet width array which typically contains between 1,000 and 4,000 stylii or electrode elements. On receipt of a signal, the stylus array is excited to a suitable potential and magnitude. Selective excitation of stylii, individually forms an electrostatic latent image on the dielectric sheet. In the alternative, an array of ion guns may be utilized in lieu of the stylii array. Other suitable electrode arrangement, as disclosed in the prior art, may also be utilized. Backing plate 98 is electrically grounded.

After the electrostatic latent image has been formed on the dielectric plate by the selective energization of the stylus array, the dielectric sheet passes through moistening station D. At moistening station D, roller 54 applies a metered quantity of liquid to the backside of the dielectric sheet improving the conductivity thereof. Thereinafter, the dielectric sheet passes through developement station E.

At development station E, tubular member 72 deposits magnetic particles on the electrostatic latent image forming a powder image thereon.

Thereinafter, the dielectric sheet with the particle image thereon passes through fusing station F. At fusing station F, heated fuser roller 82 and backup roller 80 apply heat and pressure to the powder image permanently affixing it to the dielectric sheet. Thereinafter, conveyor 80 advances the dielectric sheet with the powder image permanently affixed thereto, in the direction of arrow 50, to catch tray 90 for subsequent removal from the printing machine by the machine operator.

It is thus apparent that in this latter mode of operation, the printing machine operates in an electrographic mode of operation. Thus the electrostatographic printing machine heretofore described may operate in either an electrographic or electrophotographic mode. Not only may it operate in either of these modes individually but in combination with one another. For example, an electrostatic latent image may be formed on the photoconductive surface by the utilization of a cathode ray tube and/or the information contained within an opaque original document disposed upon the moving transparent platen. The resultant composit electrostatic latent image may then be transferred to the dielectric sheet. Thereinafter, information may be recorded on the dielectric sheet by the stylus array. Thus, an electrostatic latent image may be formed on the dielectric sheet which contains information from an opaque original document, a cathode ray tube, and a stylus array. The resultant electrostatic latent image may contain information from all or any of the foregoing.

In recapitulation, it is evident that the multimode electrostatographic printing machine of the present invention forms an electrostatic latent image on a dielectric sheet. The electrostatic latent image may contain information from an opaque original document, a cathode ray tube, and a stylus array. The resultant electrostatic latent image may be formed from the information contained in any one or all of the foregoing. This latent image is then developed and permanently affixed to the dielectric sheet forming a copy of the information contained within the cathode ray tube, opaque original document, or the stylus array.

It is apparent that the multi-mode electrostatographic printing machine operates in the electrophotographic mode of operation and the electrographic mode of operation. The electophotographic mode of operation utilizes either a cathode ray tube or an opaque original document, or both of the foregoing. The electrographic mode of operation employs a stylus array or any equivalent electrode known in the art. The operator may select any single mode of operation or any combination of modes of operation merely by depressing the appropriate button or buttons. For example, depression of the cathode ray tube button actuates only the cathode ray tube. Similarly, depression of the copier button actuates only the opaque original document mode of operation. Finally, actuation of the stylus array button merely actuates the stylus array. In order to actuate a combination of the foregoing, any two or all three of the foregoing buttons must be depressed.

While a cathode ray tube has been hereinbefore described, one skilled in the art will appreciate that any other electronic imaging technique may be employed, such as using a laser beam or a plurality of fiber optics to form an electrostatic latent image on the photoconductive member.

It is, therefore, evident that there has been provided, in accordance with the present invention, a multi-mode electrostatographic printing machine that fully satisfies the aims and advantages hereinbefore set forth. While this invention has been described in conjunction with a specific embodiment thereof, it will be evident that many alternatives, modifications, and variations will be apparent to those skilled in the art. Accordingly, it is intended to embrace all such alternatives, modifications, and variations as fall within the spirit and broad scope of the appended claims.

What is claimed is:

1. A multi-mode electrostatographic printing machine including:

a photoconductive member;

a dielectric member having a substrate coated with a layer of material capable of retaining an electrostatic latent image;

means for transporting said dielectric member along a path of travel which positions said dielectric member closely adjacent to said photoconductive member;

means for charging at least a portion of said photoconductive member to a substantially uniform level;

means for irradiating the charged portion of said photoconductive member with a beam of radiation to record a first electrostatic latent image on said photoconductive member;

means for transferring the first electrostatic latent image from said photoconductive member to said dielectric member;

means positioned along the path of travel of said dielectric member for forming a second electrostatic latent image on said dielectric member;

means for depositing particles on said dielectric member to develop the electrostatic latent image;

means for moistening said dielectric member to increase the conductivity of said dielectric member prior to said depositing means developing the electrostatic latent image with particles;

means for affixing substantially permanently said particles to said dielectric member; and operator selectable means for energizing said charging means, said irradiating means and said forming means simultaneously or energizing either said charging means and said irradiating means or said forming means independently.

2. A printing machine as recited in claim 1, wherein said irradiating means includes:

a cathode ray tube for generating a light image of an original document being reproduced; and a lens for focusing the light image of the original document onto the charged portion of said photoconductive member for recording the first electrostatic latent image thereon.

3. A printing machine as recited in claim 1, wherein said irradiating means includes:

means for supporting an original document;

means for illuminating the original document; and a lens arranged to focus a light image of the original document onto the charged portion of said photoconductive member to record the first electrostatic latent image thereon.

4. A printing machine as recited in claims 2 or 3, wherein said depositing means includes:

a non-magnetic tubular member;

means for generating a magnetic field to attract the particles to the exterior surface of said tubular member; and means for producing relative movement between said tubular member and said generating means to advance the particles adhering to said tubular member into contact with the electrostatic latent image on said dielectric member.

5. An apparatus as recited in claim 4 further comprising:

a conductive member for supporting said dielectric member closely adjacent to said photoconductive member; and means for applying an electric field between said photoconductive member and said conductive member to transfer the first electrostatic latent image from said photoconductive member to said dielectric member.

* * * * *